US005143014A

United States Patent [19]

Gabison

[11] Patent Number: 5,143,014

[45] Date of Patent: Sep. 1, 1992

[54] TARPAULIN DRAINAGE SYSTEM

[76] Inventor: Daniel Gabison, 14553 SW. 77th St., Miami, Fla. 33183

[21] Appl. No.: 640,233

[22] Filed: Jan. 11, 1991

[51] Int. Cl.[5] ..... B63B 17/00

[52] U.S. Cl. ..... 114/361; 135/89

[58] Field of Search ..... 114/201 R, 361, 343; 135/88, 89, 90, 91, 120; 150/154, 166; 296/100, 101

[56] References Cited

U.S. PATENT DOCUMENTS 3,475,772 11/1969 Lokken ..... 114/361

4,768,457 9/1988 Jones ..... 114/361

*Primary Examiner*—Jesûs D. Sotelo

*Attorney, Agent, or Firm*—Malloy, Downey & Malloy

[57] ABSTRACT

A drainage system for draining water from a top surface of a tarpaulin to prevent accumulation of water thereon, having a drain fitting including a top plate having a central aperture extending therethrough and a rigid tube integrally formed about the central aperture and extending downwardly therefrom. An open bottom end of the tube has a cutting edge formed thereabout terminating at a sharpened distal point structured and configured for puncturing and passage through the tarpaulin. A bottom keeper plate and locking element are removably fitted about the rigid tube being removably positionable into engagement with a lower surface of the tarpaulin in clamping relation to the top plate on the top surface of the tarpaulin so as to maintain the drain fitting in fixed attachment thereto. A flexible conduit is removably connected at one end to the open end of the rigid tube with an opposite end positioned in a drain hole or bilge of the boat so that water will drain thereto from the top surface of the tarpaulin.

5 Claims, 2 Drawing Sheets

TARPAULIN DRAINAGE SYSTEM

BACKGROUND OF THE INVENTION

Usually, when a boat is not being used, a tarpaulin or like cover is placed over the top of the boat so that the boat will be protected from excessive wear and damage from the sun's rays and rain water.

A common problem associated with most tarpaulin and other like boat covers is the excessive accumulation of rain water on a top surface thereof which causes the tarpaulin to sag and stretch towards a center portion thereof. The weight of the accumulated water makes it difficult to remove the tarpaulin when it is desired to use the boat. Additionally, the excessive weight of the accumulated water on the top surface of the tarpaulin often causes the securing means on the tarpaulin to give way resulting in the collapse of the tarpaulin and entry of the accumulated water into the interior of the boat.

In the past, there have been numerous attempts to prevent the accumulation of excess water on tarpaulins or boat covers. One attempt in solving this problem is the placement of a pole extended in a substantially vertical orientation between a deck of the boat and a center portion of the tarpaulin on a lower side thereof so as to form a tent-like configuration. While this method is somewhat effective, water still accumulates in several areas between the pole and the side of the boat. Additionally, the force exerted by the pole on the center of the tarpaulin causes the tarpaulin to be stretched thereby permanently damaging the original taut fitting of the tarpaulin.

Another attempt at solving the problem of preventing excessive water from accumulating on the top surface of the tarpaulin includes placing a bow-shaped member between the opposite gunnels on an underside of the tarpaulin so as to raise a center portion thereof above the level of the sides of the boat. This method also causes the tarpaulin to be stretched from its desired taut fitting configuration. Also, the bow tends to slip out of place as puddles begin to form on the top surface of the tarpaulin near the sides of the boat.

A somewhat more effective solution to the longstanding problem associated with boat covers is found in the patent to Lokken, U.S. Pat. No. 3,475,772. The patent to Lokken discloses a drain attachment for flexible boat covers comprising a fitting secured to the boat cover having a bore extending therethrough adapted to extend through an opening in the cover, and further including an out-turned flange at the upper end thereof for engagement with the upper surface of the cover. A clamping element is removably attached to the fitting for clamping of the fitting to upper and lower surfaces of the boat cover. A flexible conduit is connected to the fitting and to a conventional drain outlet in the transom of the boat so that water is permitted to be drained therethrough from an upper surface of the cover. While the drain attachment disclosed in Lokken is effective for its intended purpose, there still exists a need in the related art for a tarpaulin drainage system adapted to be easily and readily installed on existing boat covers or tarpaulins so that the accumulation of water on a top surface thereof will be prevented.

Accordingly, it is an object of the present invention to provide a drainage system for a tarpaulin or boat cover to drain water from a top surface thereof thereby effectively preventing accumulation of water thereon.

It is another object of the present invention to provide a drainage system which is adapted for easy and ready attachment with any existing boat cover or tarpaulin.

It is a further object of the present invention to provide a tarpaulin drainage system comprising a drain fitting having a downwardly extending rigid tube structured and configured to puncture the tarpaulin so that the drainage system may be easily and readily attached thereto.

It is still another object of the present invention to provide a tarpaulin drainage system comprising a drain fitting having a rigid tube integrally formed with a top plate wherein the rigid tube includes an open bottom end having a cutting edge and sharpened distal point disposed thereon for puncturing the tarpaulin so that the rigid tube may be passed therethrough.

SUMMARY OF THE INVENTION

Briefly, in accordance with a preferred embodiment of the invention, there is provided a tarpaulin drainage system comprising a drain fitting having a substantially flat top plate with a central aperture formed therein. A rigid tube is integrally formed about the central aperture extending downwardly from a lower side of the top plate wherein the rigid tube includes an open bottom end having a cutting edge disposed thereabout terminating at a sharpened distal point. The cutting edge and sharpened point are specifically structured and configured for puncturing through a tarpaulin or like boat cover so that the rigid tube extends therethrough with the top plate disposed in overlying engagement with a top surface of the tarpaulin. A keeper plate and locking means are removably fitted about the rigid tube on an underside of the tarpaulin, the keeper plate being positionable into engagement with a bottom surface of the tarpaulin in clamping relation to the top plate so as to effectively maintain the fitting in attached relation to the tarpaulin. A flexible conduit is attachable at one end to the bottom open end of the rigid tube with an opposite end of the conduit being placed in a bilge of the boat or through a drain hole thereof so that water will flow from the top surface of the tarpaulin through the central aperture of the top plate and down through the conduit into the bilge or out through the drain hole.

The invention accordingly comprises the features of construction, combination of elements and arrangement of parts which will be set forth in the description which follows and the scope of the invention will be indicated in the claims.

BRIEF DESCRIPTION OF THE PREFERRED EMBODIMENT

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
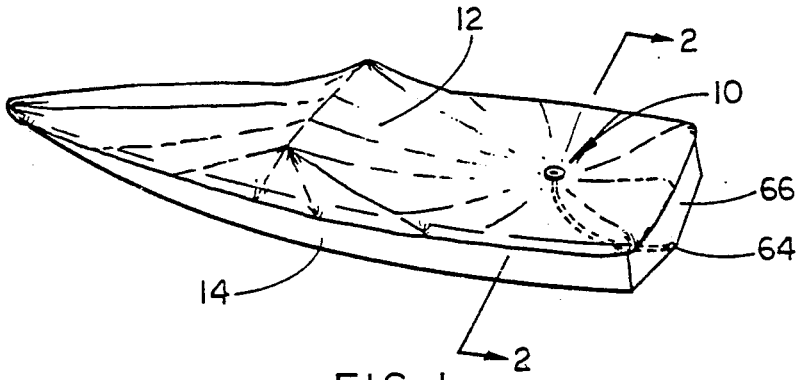
FIG. 1 is a perspective view of a tarpaulin fitted over the top of a boat in covering relation thereto illustrating the attachment of the drainage system of the present invention therewith.
Figure 2:
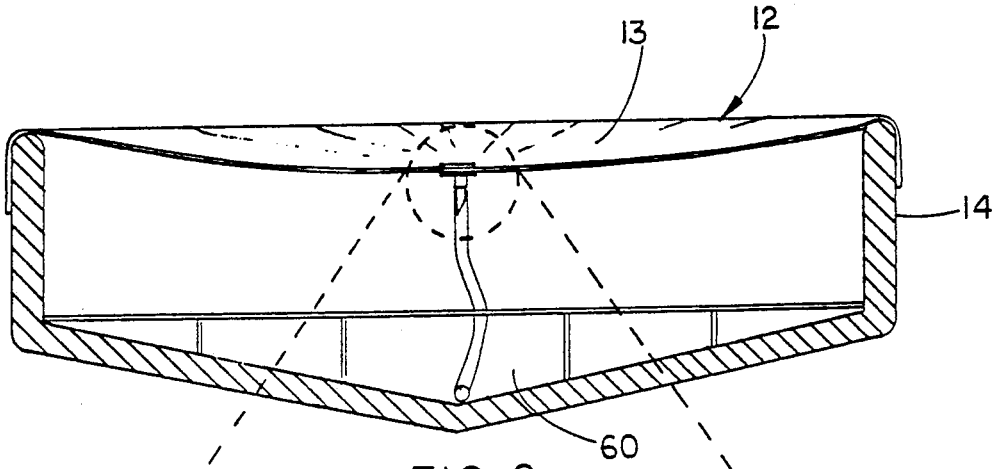
FIG. 2 is a cross-sectional view taken along lines 2—2 of FIG. 1 illustrating the attachment of the drainage system of the present invention to a lowest point of the tarpaulin.
Figure 3:
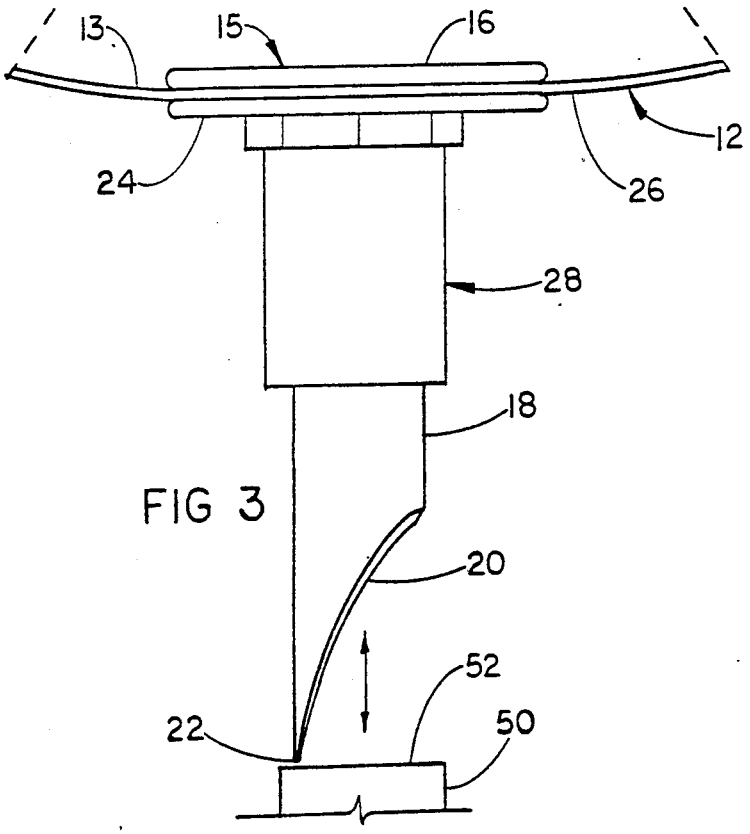
FIG. 3 is an isolated view taken from the dotted lines of FIG. 2 illustrating the attachment of the present invention to the tarpaulin.

In accordance with a preferred embodiment of the present invention, FIG. 1 illustrates a drainage system generally indicated as 10 adapted for connection with a tarpaulin or boat cover 12 normally fitted in covering relation over the top of a boat 14. As illustrated in FIGS. 2 and 3, the drainage system 10 of the present invention is attached to the tarpaulin 12 at preferably the lowest point of the tarpaulin which is usually near a center portion thereof. The drainage system 10 includes a flat top plate 16 normally disposed in a substantially horizontal orientation and a downwardly extending rigid tube 18 integrally formed therewith. The rigid tube 18 includes an open lower end having a cutting edge 20 disposed thereabout and terminating at a sharpened distal point 22. A bottom keeper plate 24 is normally positioned in engagement with a bottom surface 26 of the tarpaulin 12, wherein a locking means 28 forces the keeper plate upwardly into clamping relation with the top plate 16 so as to effectively sandwiched the tarpaulin 12 therebetween thereby effectively attaching the drain member 15 to the tarpaulin 12.

Figure 4:
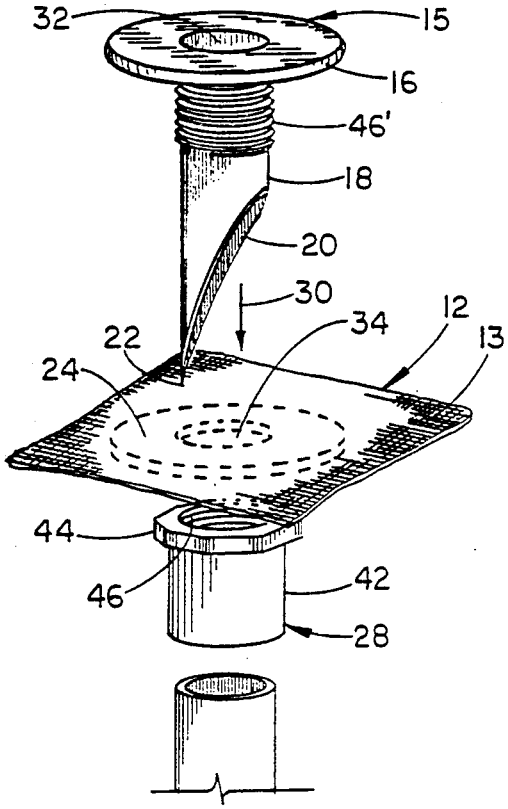
FIG. 4 is an exploded view shown in perspective illustrating a preferred embodiment of the present invention.

Referring to FIG. 4, an important feature of the present invention is illustrated wherein the rigid tube 18 of the drain member 15 is passed through the tarpaulin 12 by forcing the drain member 15 downwardly in the direction of the arrow 30 so that the sharpened distal end 22 punctures through the tarpaulin 12 with cutting edge 20 further cutting through the tarpaulin so that the rigid tube 18 is able to pass therethrough. A central aperture 32 extending through the top plate 16 is disposed in fluid communication with a hollow interior of the rigid tube 18 so that water will readily flow therethrough.

Figure 5:
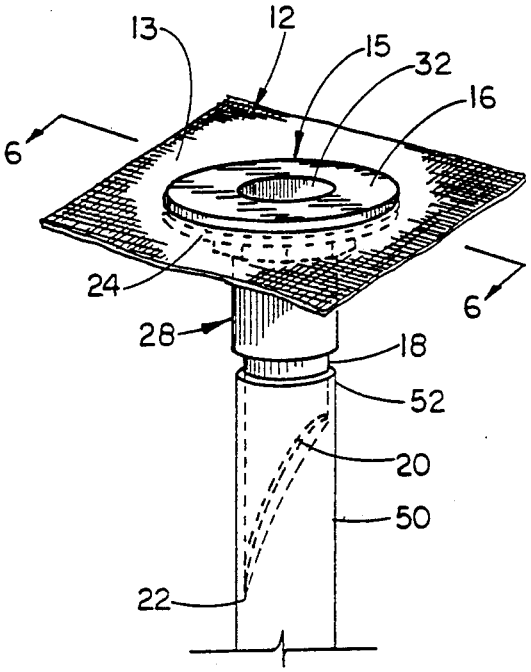
FIG. 5 is a perspective view of a preferred embodiment of the present invention shown in attachment with a tarpaulin or boat cover.
Figure 6:
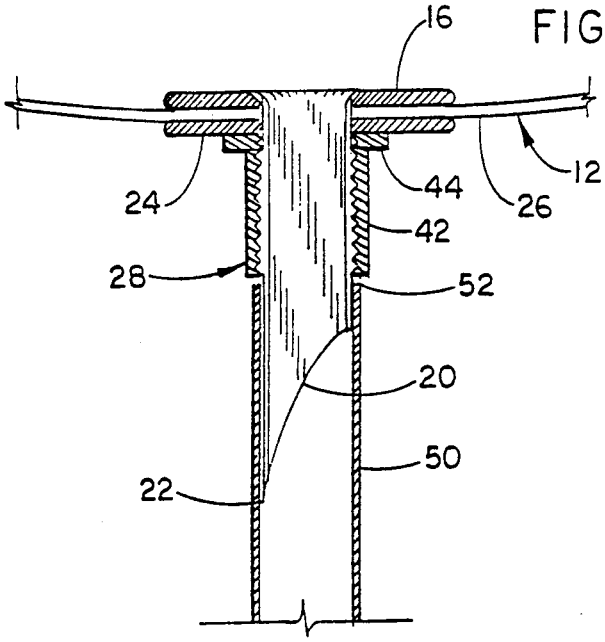
FIG. 6 is a sectional view taken along lines 6—6 of FIG. 5 illustrating the interconnection of various elements of the preferred embodiment of the present invention.

Once having punctured the tarpaulin with the rigid tube extending therethrough, the bottom keeper plate 24 having an aperture 34 formed therein is positioned about the rigid tube 18 into engagement with the bottom surface 26 of the tarpaulin 12 as seen in FIGS. 5 and 6. The locking means 28 having a tubular portion 42 and a flanged end 44 is fitted about the rigid tube 18 wherein a threaded inner surface 46 is threadably engaged with a threaded outer surface 46' of the rigid tube 18. Threaded advancement of the locking means 28 upwardly along the length of the rigid tube 18 results in engagement of the flanged end 44 with the bottom keeper plate 24 forcing the keeper plate 24 upwardly into clamping relation with the top plate 16.

A lower side of the top plate 16 as well as an upper side of the bottom keeper plate 24 include a roughened or toothed surface for grasping engagement with the opposite sides of the tarpaulin 12, thereby effectively preventing relative movement therebetween.

A flexible conduit 50 is removably attachable at one end 52 to the open bottom end of the rigid tube 18. Preferably, the inner circumference of the flexible tube 50 is slightly greater than the outer circumference of the rigid tube 18 so that the end 52 of the conduit 50 can be slidably received over the open bottom end of the rigid tube 18 as seen in FIGS. 5 and 6. As shown in FIGS. 1 and 1, an opposite end 54 of the flexible conduit 50 can be positioned in either the bilge portion 60 of the boat or a drain hole 64 formed in the lower transom 66 of the boat 14.

Accordingly, when the boat is in the water, rain water will effectively drain from the top surface 13 of the tarpaulin 12 down through the central aperture 32, through the hollow rigid tube 18 and through the flexible conduit 50 into the bilge 60. The boat is out of the water, the rain water will be drained into the bilge 60 and then will be drained out through the drain hole 64 once a plug is removed therefrom. When the boat is in the water, and the drain hole is plugged, an automatic bilge pump in the boat 14 will then pump the collected water in the bilge 60 overboard when the water reaches a predetermined level.

While the instant invention has been shown and described in what is considered to be a practical and preferred embodiment, it is recognized that departures may be made within the spirit and scope of this invention which is, therefore, not to be limited except as set forth in the claims hereinafter and within the doctrine of equivalents.

Now that the invention has been described, what is claimed is:

1. A drain apparatus for draining water from a top surface of a tarpaulin for covering a boat having a bilge and a drain hole through a transom thereof, the apparatus comprising:

a first member including a substantially flat top plate having a central aperture extending therethrough, said top plate structured and disposed for overlying engagement with the top surface of the tarpaulin in a substantially horizontal orientation, said first member further including an elongate, hollow tube integrally formed about said central aperture on a lower side of said top plate and extending perpendicularly and downwardly therefrom, said hollow tube disposed in liquid receiving relation to the top surface of the tarpaulin and said central aperture, said hollow tube including an open bottom end having a cutting edge disposed thereabout, said cutting edge terminating at a substantially sharp distal point, said cutting edge and said distal point being structured and configured for puncturing said tarpaulin so that said hollow tube can be readily passed therethrough in a substantially vertical orientation relative to said top plate and the tarpaulin, a bottom keeper plate having an aperture formed therein being adapted for removable receipt about said hollow tube so as to be positioned in engaging relation with a bottom surface of said tarpaulin, locking means for forcing said bottom keeper plate into clamping relation to said top plate so as to maintain said first member in fixed attachment with the tarpaulin, and an elongate, substantially flexible conduit having a first end adapted for removable connection with said open bottom end of said hollow tube, said flexible conduit further having a second, opposite end adapted to be positioned in a drainage location, whereby water will drain from the top surface of the tarpaulin through said hollow tube and said flexible conduit attached thereto and out through said second, opposite end thereof.

2. An apparatus as in claim 1 wherein said lower side of said top plate and an upper side of said bottom keeper plate include a roughened surface structured and disposed for grasping the top surface and a bottom surface of the tarpaulin respectively so as to prevent relative movement therebetween.

3. An apparatus as in claim 2 wherein said locking means includes a tubular fitting having a flanged end, said tubular fitting including a threaded inner surface adapted for threaded engagement with a threaded outer surface of said hollow tube, wherein threaded manipulation of said tubular fitting causes advancement thereof along the length of said hollow tube so as to force said flanged end into engagement with said bottom keeper plate.

4. An apparatus as in claim 3 wherein said top plate includes a downwardly depending annular surface disposed about said central aperture for directing water flow therethrough.

5. An apparatus as in claim 4 wherein said flanged end of said tubular fitting includes a hexagonal outer edge adapted for receipt of a wrench for said threaded manipulation of said tubular fitting.

* * * * *